US011105104B2

(12) United States Patent
Deifel et al.

(10) Patent No.: US 11,105,104 B2
(45) Date of Patent: Aug. 31, 2021

(54) FORMWORK APPARATUS AND METHOD FOR PRODUCING VERTICAL WALL SECTIONS THAT INCLUDE CONNECTION REINFORCEMENT ELEMENTS FOR A FLOOR

(71) Applicant: Peri GmbH, Weissenhorn (DE)

(72) Inventors: Dieter Deifel, Blaustein (DE); Andre Zwerenz, Oy-Mittelberg (DE)

(73) Assignee: PERI Formwork Systems, Inc., Elkridge, MD (US)

( * ) Notice: Subject to any disclaimer, the term of this patent is extended or adjusted under 35 U.S.C. 154(b) by 0 days.

(21) Appl. No.: 16/294,546

(22) Filed: Mar. 6, 2019

(65) Prior Publication Data

US 2019/0323246 A1 Oct. 24, 2019

(30) Foreign Application Priority Data

Mar. 6, 2018 (DE) ..... 10 2018 203 262.9

(51) Int. Cl.
*E04G 11/28* (2006.01)
*E04G 17/00* (2006.01)
*E04G 17/02* (2006.01)

(52) U.S. Cl.
CPC ..... *E04G 11/28* (2013.01); *E04G 17/007* (2013.01); *E04G 17/02* (2013.01)

(58) Field of Classification Search
CPC ..... E04G 11/28; E04G 17/007; E04G 17/02; E04G 17/047; E04G 17/001
USPC ..... 249/44, 19
See application file for complete search history.

(56) References Cited

U.S. PATENT DOCUMENTS 1,988,900 A 1/1935 Heltzel
3,327,986 A * 6/1967 Oury ..... E04G 17/07 249/45
3,661,354 A * 5/1972 Dagiel ..... E04G 11/10 249/192
3,687,411 A * 8/1972 Frazier ..... E04G 9/02 249/44

(Continued)

FOREIGN PATENT DOCUMENTS

CN 103029204 4/2013
DE 202007017994 U1 4/2008

(Continued)

*Primary Examiner* — Paola Agudelo
(74) *Attorney, Agent, or Firm* — Loginov & Associates, PLLC; William A Loginov

(57) ABSTRACT

A formwork apparatus for producing a wall section in fresh concrete design that includes projecting connection reinforcement elements for connecting a floor to be constructed, comprising a formwork element that includes a support structure and a forming panel supported on the support structure. The formwork element is provided on one of its edge sections with a plurality of edge recesses spaced preferably uniformly apart from one another for the connection reinforcement elements. A single forming board element or multiple forming board elements serve to reversibly cover the edge recesses when the connection reinforcement elements extend through the edge recesses. A method for producing wall sections situated vertically above one another with projecting connection reinforcement elements in fresh concrete design for connecting to a floor.

15 Claims, 13 Drawing Sheets

(56) References Cited

U.S. PATENT DOCUMENTS

| | | | | | |
|---|---|---|---|---|---|
| 4,397,441 | A * | 8/1983 | Manderla | E04G 11/28 | 249/19 |
| 5,065,560 | A * | 11/1991 | Yoder | E04B 2/24 | 52/306 |
| 5,956,922 | A * | 9/1999 | Liuska | E04G 11/065 | 249/216 |
| 6,070,380 | A * | 6/2000 | Meilleur | E04B 2/8617 | 52/309.11 |
| 6,443,418 | B1 * | 9/2002 | Itamochi | E02D 27/02 | 249/190 |
| 2010/0071306 | A1 * | 3/2010 | Williams | E04B 2/8617 | 52/712 |
| 2011/0232218 | A1 * | 9/2011 | Hynes | E04G 11/10 | 52/319 |
| 2013/0119228 | A1 * | 5/2013 | Kamata | E04B 2/8635 | 249/15 |
| 2013/0341813 | A1 | 12/2013 | Baum | | |
| 2014/0263942 | A1 * | 9/2014 | Ciuperca | B29C 33/02 | 249/78 |

FOREIGN PATENT DOCUMENTS

| | | |
|---|---|---|
| EP | 1338724 | 8/2003 |
| EP | 3228776 | 10/2017 |

* cited by examiner

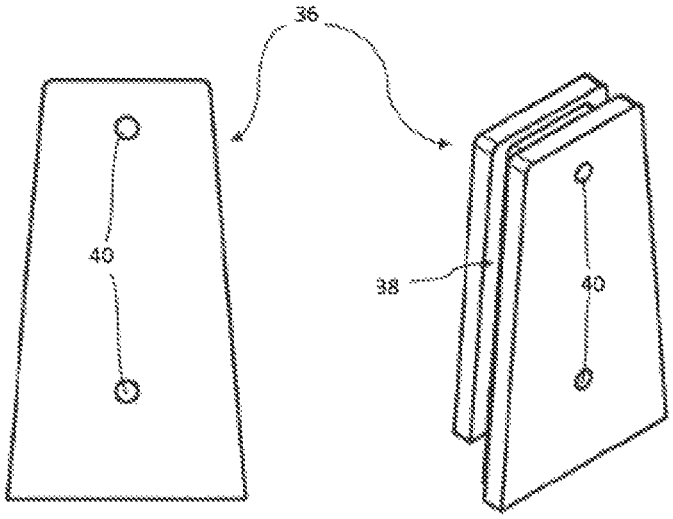
Fig. 2A
Fig. 2B
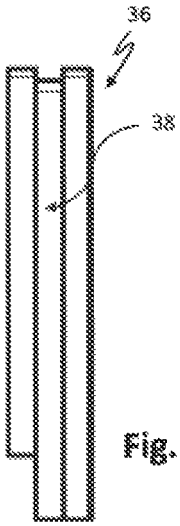
Fig. 2C
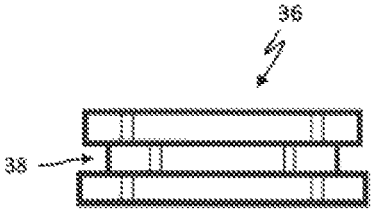
Fig. 2D

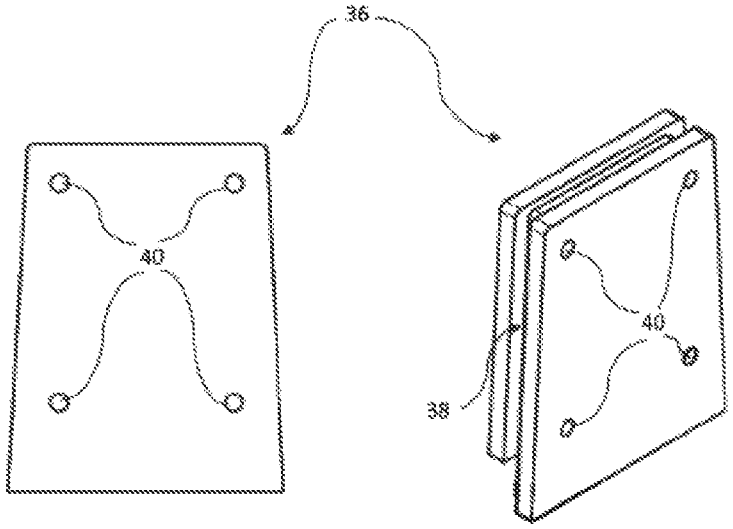
Fig. 3A
Fig. 3B
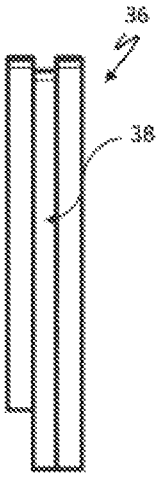
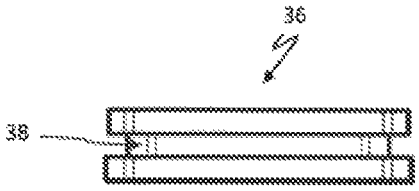
Fig. 3C
Fig. 3D

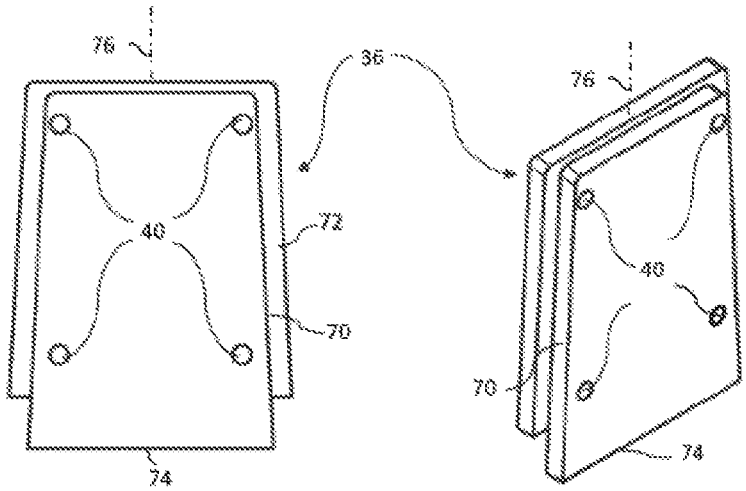
Fig. 11A
Fig. 11B
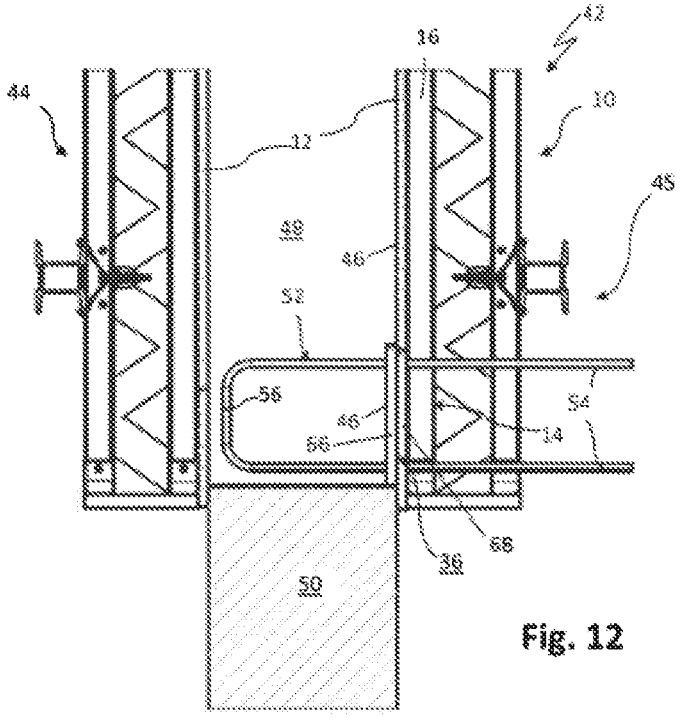
Fig. 12

FORMWORK APPARATUS AND METHOD FOR PRODUCING VERTICAL WALL SECTIONS THAT INCLUDE CONNECTION REINFORCEMENT ELEMENTS FOR A FLOOR

In concrete construction, vertical wall sections for connecting floors and the like are generally provided with a so-called connection reinforcement, the individual connection reinforcement elements of which protrude from the wall section. So-called rebending connections are available on the market, with which a smooth, precisely aligned construction joint may be created with the formwork, without the need for drilling through the framework. In contrast to the so-called bolt connections, these rebending connections are also distinguished by lower procurement costs and installation costs.

Rebending connections are limited, however, by the maximum bar diameter. Normally, only connections having a reinforcing steel diameter of up to and including 12 millimeters are possible, so that stricter fire safety requirements cannot be readily met. In practice, therefore, connection reinforcement elements made of shaped reinforcing steel are usually used. These are frequently L-shaped or U-shaped and are usually poured in sections into the respective concrete wall section to be produced in fresh concrete design.

When constructing a multi-story concrete structure, it is known to use sliding formwork and climbing formwork for reasons of time and costs. The aforementioned connection reinforcement elements in this case represent a significant disturbance factor. Thus, in practice, it is generally necessary after stripping the solidified wall section to move the formwork elements in a cumbersome manner around the connection reinforcement elements to the next higher construction section. This is costly in terms of time, personnel and expense.

The object of the invention, therefore, is to specify a formwork apparatus and a method, with which vertical wall sections may be more simply and cost-efficiently produced in fresh concrete design, in each case with projecting connection reinforcing elements.

The object relating to the formwork apparatus is achieved by a formwork apparatus having the features specified in claim 1. The method according to the invention includes the features specified in claim 10. Preferred refinements of the invention are specified in the subclaims as well as in the description.

The formwork apparatus according to the invention includes a formwork element with a support structure and a forming panel with a formwork facing supported on the support structure. The formwork facing is the surface of the forming panel that comes into contact with the fresh concrete, which is used for concreting the wall section to be constructed. The support structure may comprise multiple framework members, for example, in half-timbered design, which are detachably connected with one another. According to the invention, the lower edge section of the framework element includes a plurality of edge recesses spaced preferably uniformly apart from one another for the passing through of the connection reinforcement elements of the wall section to be constructed. Thus, the formwork element includes indentations spaced apart from one another along its lower edge section, which serve to hold the aforementioned connection reinforcement elements, in particular, reinforcement bars made of steel. As a result, when forming the wall section to be constructed in fresh concrete design, the formwork element may be easily situated in its forming position predefined for each wall section to be constructed. If, for example, the connection reinforcement elements, for example, in the shape of L-shaped bent reinforcement bars, are already anchored at one end in an underlying concrete structure or wall section, then it is possible to slide the formwork element vertically onto these connection reinforcement elements and/or in a direction orthogonal to the wall section. According to the invention, the formwork apparatus includes a forming board element or multiple forming board elements for reversibly covering the edge recesses when the connection reinforcement elements extend through the edge recesses. This can counteract an undesirable escaping of fresh concrete via the edge recesses when concreting the wall section. Thus, each forming board element serves as a sealing element. The forming board element, if it is designed, for example, in the shape of a single formwork board, includes a plurality of through-recesses for the connection reinforcement elements of the wall sections to be constructed. The individual formwork board in this case preferably has a length corresponding to the width of the formwork element. This offers cost and time advantages when forming the wall section to be constructed. In the case of multiple forming board elements, each of the forming board elements is provided in each case with at least one through-recess, preferably with multiple through-recesses.

According to one particularly preferred embodiment of the invention, each forming board element is movable out of its mounted position on the formwork element in a direction axial to the longitudinal axis of the formwork element. In this way, the formwork element may be simply stripped and moved vertically upward from the connection reinforcement elements of the solidified wall section. Moving the formwork element away from the wall section in a direction orthogonal to the wall surface of the solidified wall section to the free end of the connection reinforcement elements is unnecessary. As a result, it is possible to strip even in the tightest of installation spaces and to move the formwork element to the next highest construction section. It should be noted that the individual forming board element or the multiple forming board elements may be removed separately from the connection reinforcement elements of the solidified wall section in a direction orthogonal to the wall surface of the wall section.

Each of the multiple forming board elements is particularly preferably mountable at least in sections in one of the edge recesses. A particularly reliable sealing of the edge recesses may be achieved as a result. In addition, an undesirable incorrect positioning of the forming board elements relative to the formwork element may be counteracted and, if needed, these forming board elements may be captively held on the formwork element.

According to the invention, each forming board element may be detachably connected via a tongue-and-groove joint with the formwork element, in particular, with the forming panel thereof. An even better sealing of the edge recesses may be achieved as a result of the tongue-and-groove joint. In addition, a more captive seating of the forming board element or of the forming board elements on the formwork element may be achieved.

According to one preferred refinement, the forming panel of the formwork element extends between two edge recesses situated immediately adjacent to one another. The forming panel is preferably also supported on its back side in these areas by the support structure. The forming panel in this case may extend to the free edge of the formwork element.

The formwork element may be designed, in particular, as a so-called frame panel formwork element, in which the formwork facing and the support structure are permanently connected to one another. The support structure in this case is formed generally by hollow profiled elements made of metal, which are detachably connected, in particular, welded to one another. The hollow profiled elements may protectively overlap, at least in sections, the edge of the forming panel.

If the width of the edge recesses of the formwork element tapers toward the center or toward the opposite upper end of the formwork element, then the individual forming board inserts may be inserted into the edge recesses of the formwork element in a particularly reliably sealing manner.

The forming board element/the forming board sealing elements, in their mounted position with their formwork facing (formwork surface) contacting the fresh concrete, may project above the level of the formwork facing of the formwork element. As a result, the forming board elements each appear as an indentation in the solidified wall section. In the process, each indentation overlaps in each case at least one connection reinforcement element protruding out of the wall section. In this way, a connection of the respective floor to the wall section with potentially even greater load stability may be achieved.

If the formwork facing of the forming board element or of the forming board elements in its/their mounted state on the formwork element is/or situated in each case flush or essentially flush with the formwork facing of the formwork element, the wall section may then be produced with a smooth or essentially smooth surface.

The method according to the invention for producing wall sections in fresh concrete design situated vertically above one another, each of which is provided with projecting connection reinforcement elements for connecting to a floor to be constructed, comprises the following steps:

a) forming a first wall section to be constructed with a concrete formwork, which comprises at least one formwork apparatus explained above, in such a way that at least one part of the connection reinforcement elements of the wall section to be constructed extends through one each of the edge recesses of the formwork element, wherein multiple of the edge recesses of the formwork element passed through by connection reinforcement elements, preferably all together, are covered by a single forming board element, in particular, in the form of a formwork board, or in each case—separately from one another—by a separate forming board element, which is situated at least in sections in the respective edge recess.
b) introducing fresh concrete into the concrete formwork;
c) stripping the solidified wall section by
   lifting the formwork element vertically in order to disengage the connection reinforcement elements from the formwork element; and
   removing each forming board element from the respective connection reinforcement element(s) in a direction orthogonal to the wall section; and
d) forming a connecting second wall section to be constructed vertically above the solidified wall section with projecting connection reinforcement elements for connecting a floor using the formwork apparatus.

When forming the respective wall section, the individual forming board element or the forming board elements is/are particularly preferably initially threaded onto the connection reinforcement element(s) and only subsequently is the formwork element transferred into the forming position.

The invention is explained in greater detail below based on exemplary embodiments depicted in the drawing. The embodiments shown and described are not to be understood as an exhaustive enumeration, but have rather exemplary character for illustrating the invention. In the drawings:

FIG. 2 shows a forming board element, including two recesses for a connection reinforcement element and a circumferential retaining groove, in a front view (FIG. 2A), in a perspective view (FIG. 2B), in a side view (FIG. 2C) and in an end face view (FIG. 2D);

FIG. 3 shows a forming board element, including a total of four recesses for the passing through of connection reinforcement elements and including a circumferential retaining groove, in a front view (FIG. 3A), in a perspective view (FIG. 3B), in a side view (FIG. 3C) and in an end face view (FIG. 3D);

Figure 1:
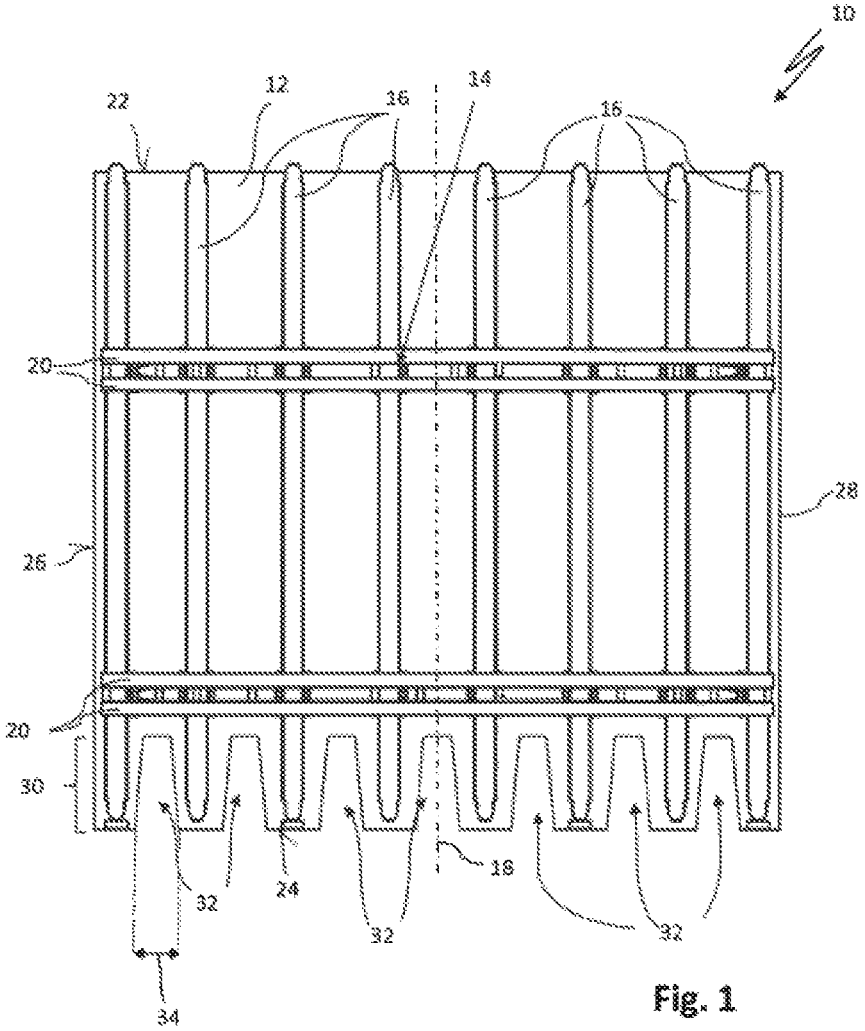
FIG. 1 shows a formwork element, including a forming panel, which is supported on the rear side on a support structure, wherein the formwork element includes multiple edge recesses along its lower edge section for connection reinforcement elements of a wall section to be constructed, in a view of the back side.
Figure 4:
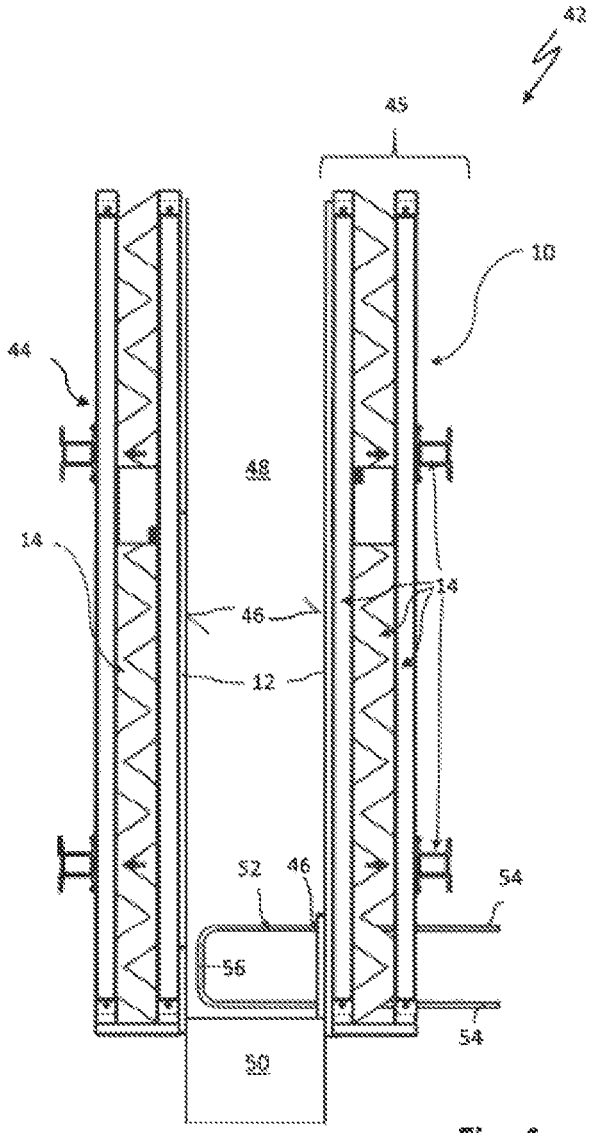
Figure 5:
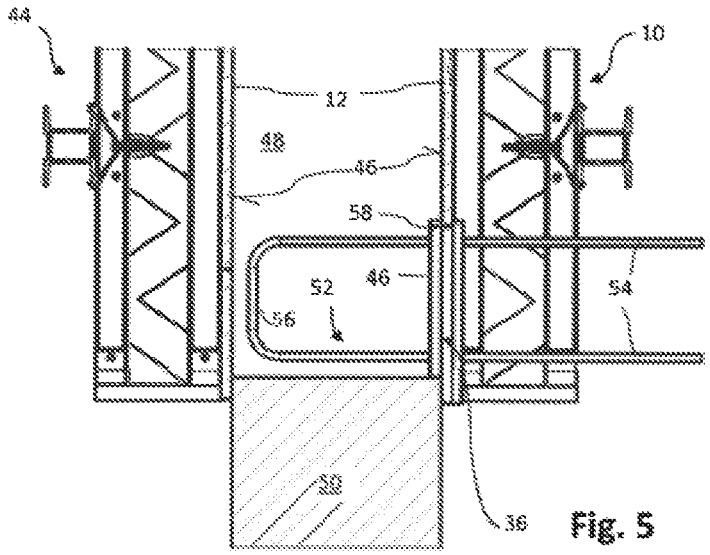
Figure 6:
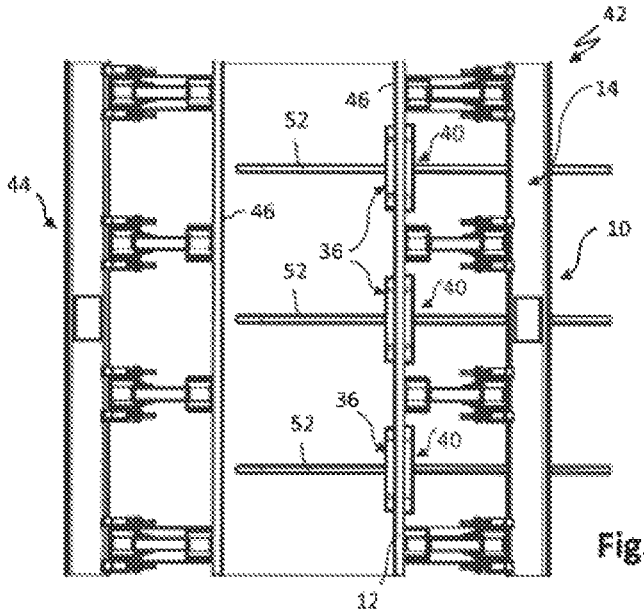
Figure 7:
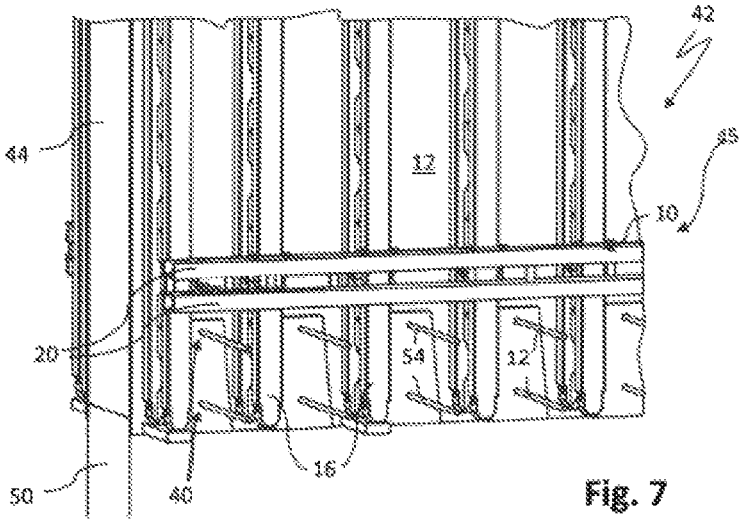
Figure 8:
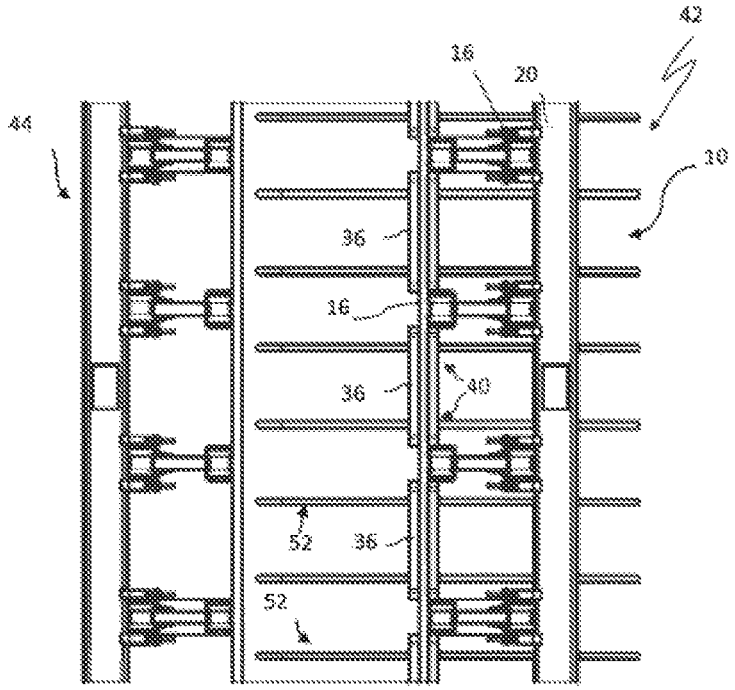
Figure 9:
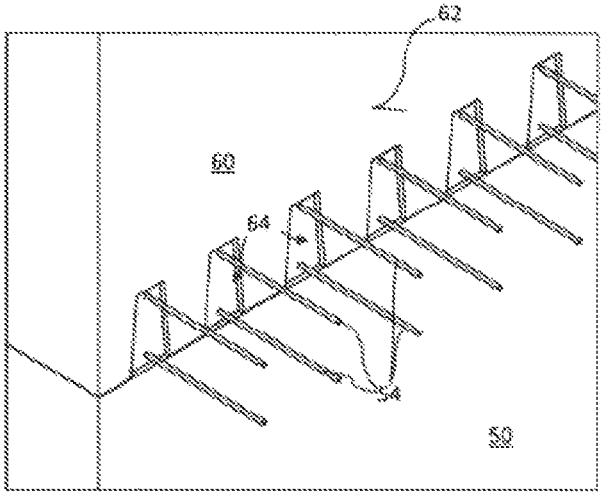
Figures 10A, 10B:
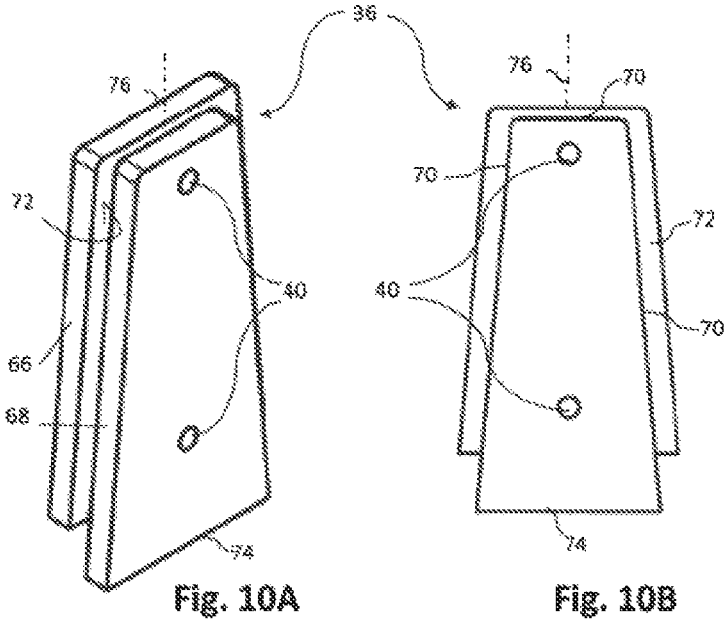
Figure 13:
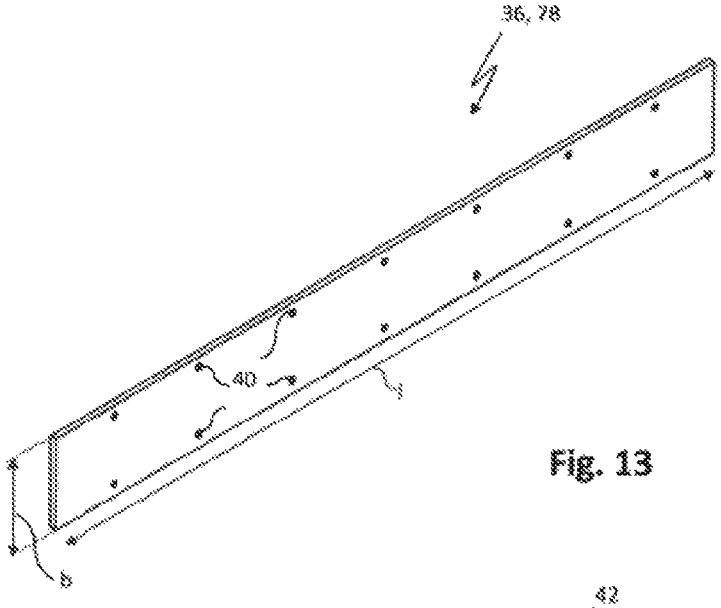
Figure 14:
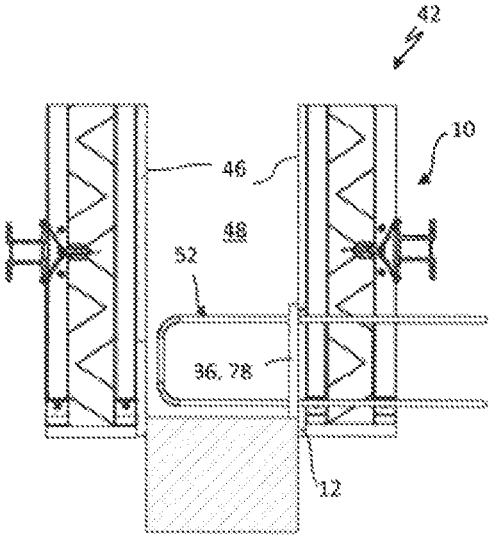
Figure 15:
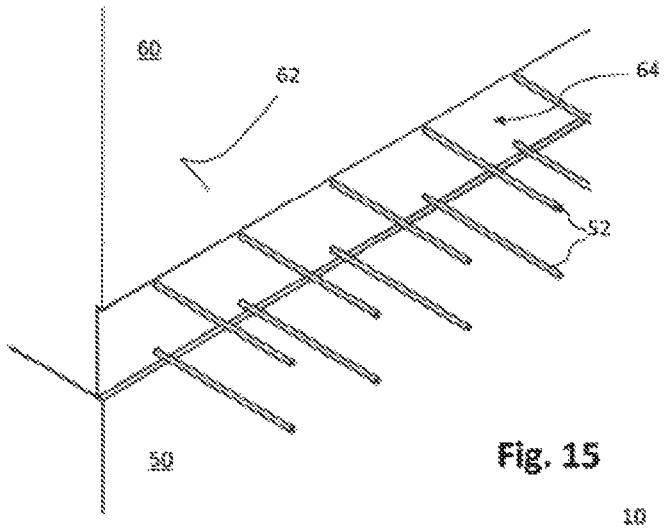
Figure 16:
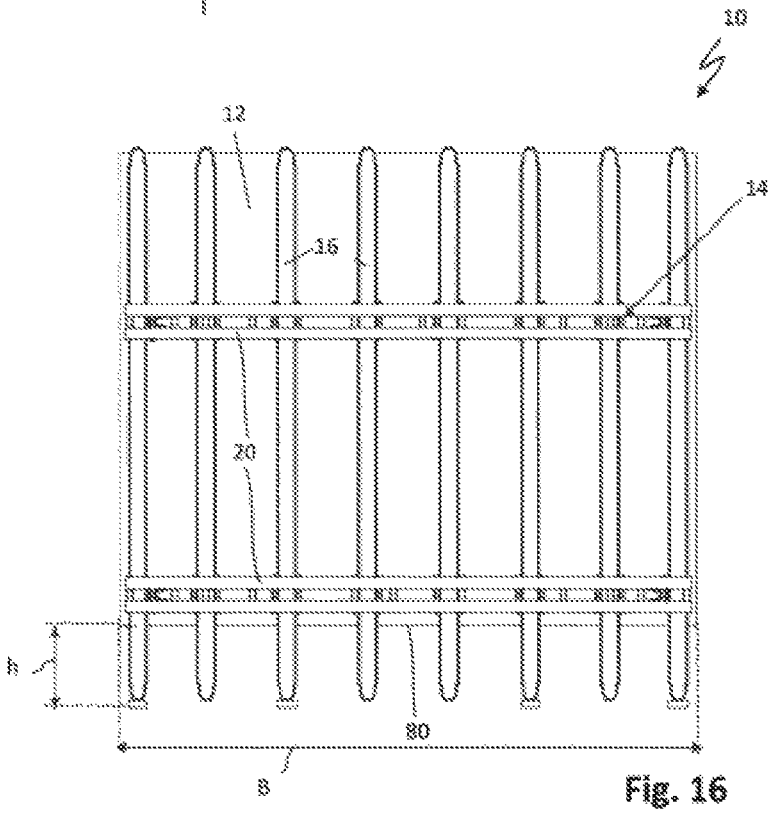
Figure 17:
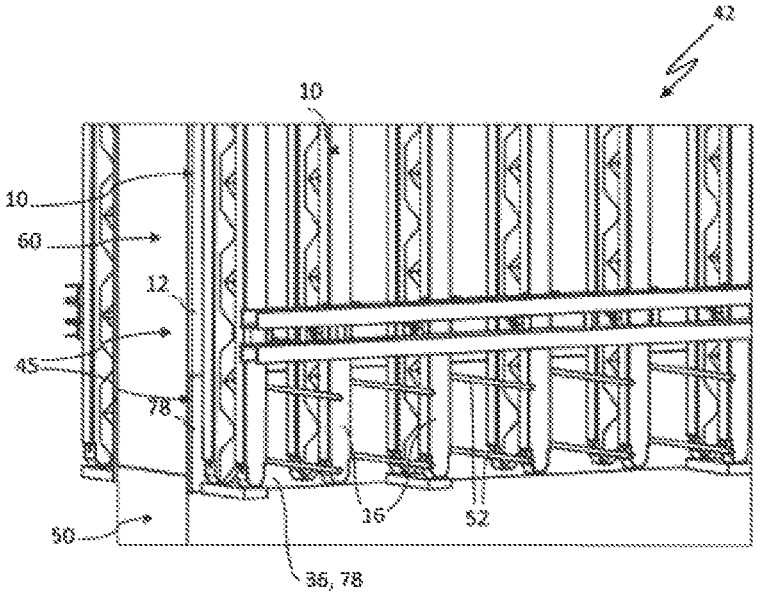
Figure 18:
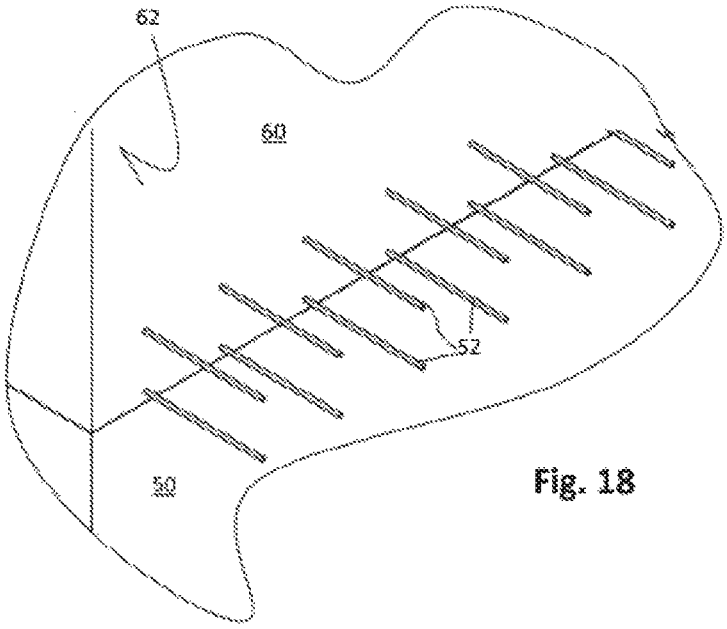
Figure 19:
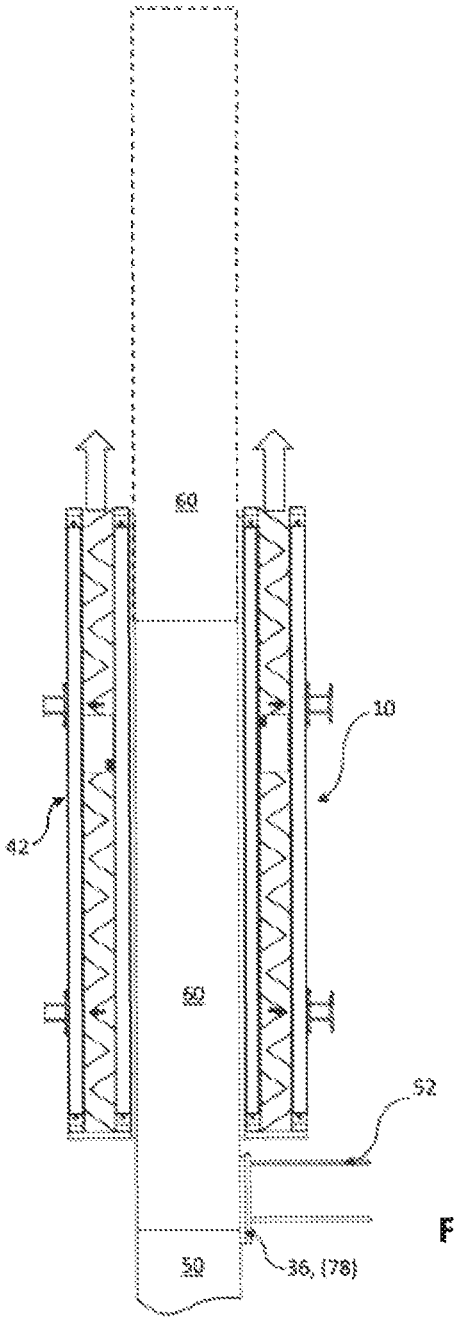
Figure 20:
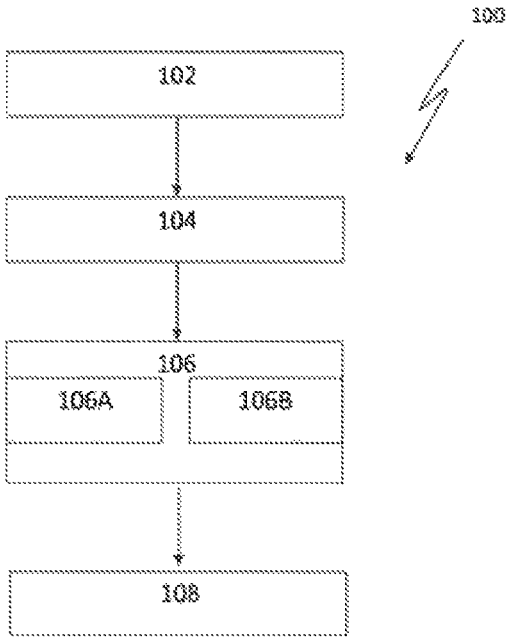

FIG. 4 shows a concrete formwork, including formwork elements situated opposite one another for producing a wall section, including projecting connection reinforcement elements in fresh concrete design, wherein the formwork element to the right in the figure is designed according to according to FIG. 1 and the connection reinforcement elements each extend through a forming board element situated in the edge recesses of the formwork element, in a side view;

FIG. 5 shows a sectional view of sections of the concrete formwork according to FIG. 4;

FIG. 6 shows a horizontal section of sections of the concrete formwork according to FIG. 4;

FIG. 7 shows a perspective detail section of the concrete formwork according to FIG. 4;

FIG. 8 shows a horizontal section of sections of a concrete framework, in which two connection reinforcement elements each extend through the same forming board element;

FIG. 9 shows a formwork pattern of a stripped, solidified wall section, including connection reinforcement elements, in a perspective view;

FIG. 10 shows an alternative forming board element, including a total of two recesses for the passing through of connection reinforcement elements in a front view (FIG. 10A) and in a perspective view (FIG. 10B);

FIG. 11 shows an alternative forming board element, including a total of four recesses for the passing through of connection reinforcement elements in a front view (FIG. 11A) and in a perspective view (FIG. 11B);

FIG. 12 shows a detail depiction of sections of a concrete formwork, including a forming board element according to FIG. 10 or 11, in a sectional view;

FIG. 13 shows a single formwork board for covering the edge recesses of a formwork element according to FIG. 1 in a perspective view;

FIG. 14 shows a concrete formwork, in which the formwork element depicted to the right in FIG. 14 is designed according to FIG. 1 and in which all connection reinforcement elements of the wall section to be constructed extend together through a formwork board according to FIG. 13 abutting the formwork facing, in a sectional view;

FIG. 15 shows the formwork pattern of the solidified wall section produced with the concrete formwork according to FIG. 14, in a perspective view;

FIG. 16 shows another embodiment of a formwork element;

FIG. 17 shows a concrete formwork, including a formwork element according to FIG. 16, in which the edge recesses are jointly covered by a single formwork board, the back side of which directly abuts the support structure of the formwork element, in a perspective view;

FIG. 18 shows the formwork pattern of a wall section produced with the concrete formwork according to FIG. 17, in a perspective view;

FIG. 19 shows a concrete formwork during stripping, in a side view;

FIG. 20 shows a block diagram, including individual method steps for producing a wall section in fresh concrete design, which is provided with connection reinforcement elements embedded in concrete for connection to a floor to be constructed, wherein the connection reinforcement elements each extend away from the wall section in a direction orthogonal to the surface of the wall section.

FIG. 1 shows a formwork element 10 in a rear view. The formwork element 10 is used to produce a wall section in fresh concrete design, which is provided with projecting connection reinforcement elements, via which the wall section may be integrated into a floor or the like. The wall section preferably includes at least one floor height. The framework element 10 comprises a so-called forming panel 12. The forming panel 12 may, for example, be made of plywood, solid wood or also of plastic. The forming panel 12 is supported on the rear side on a support structure 14. The support structure 14 in this case includes multiple, vertically extending longitudinal members 16, each of which extends along the longitudinal axis 18 of the formwork element 10. Each of the longitudinal members 16 extends in parallel to one another. The longitudinal members 16 are—in this case detachably—connected to one another via cross members 20. A detachable connection 12 is considered to be a connection that may be non-destructively released. The forming panel is preferably tightly nailed or tightly screwed to the support structure 14. Other methods of attachment familiar to the person skilled in the art are also conceivable. The longitudinal members and/or cross members 16, 20 may each also be designed as trussed girders, for example, made of wood. The formwork element 10 has an upper edge 22, a lower edge 24 as well as two opposing side edges 26, 28. Situated in the lower edge section 30 of the formwork element 10 are multiple indentations or edge recesses 32. The edge recesses 32 are designed open in the direction of the lower edge 24 of the formwork element and are situated spaced preferably uniformly apart from one another along the lower edge 24. It should be noted that the width 34 of the edge recesses 32 may decrease in the inward direction or in the direction of the upper edge 22 of the formwork element 10.

The edge recesses 32 of the formwork element 10 pass through the forming panel 12 here and in each case serve to receive the connection reinforcement elements of the wall section to be produced in fresh concrete design with the aid of the formwork element 10. The connection reinforcement elements, in other words, are able to be passed through the edge recesses of the formwork element 10. The forming panel 12 extends between two edge recesses 32 each in the direction of the lower free edge 24 of the formwork element 10 and is also supported on the rear side in this area on the support structure 14. It should be noted that the formwork element may also be designed as a so-called frame panel formwork element not further shown, in which the sides of the forming panel 12 are preferably overlapped by a circumferential (welded) frame.

FIGS. 2A through 2D show a forming board element 36 in different views. The forming board element 36 includes a base form corresponding to the edge recesses 32 of the framework element 10 shown in FIG. 1, in this case, for example, in the form of an isosceles trapezoid. The forming board element 36 may be made of solid wood, plywood or also of plastic. The forming board element 36 includes a groove 38 on three of its sides, in order to be able to insert the forming board element 36 in each case via a tongue-and-groove joint in one of the edge recesses 32 of the formwork element and, optionally, to fasten by press fitting onto the formwork element 10. Two through-recesses 40 are used for the passing through of a connection reinforcement element. The forming board element 36 serves as a sealing element, which counteracts an undesirable escaping of fresh concrete via the respective edge recess of the formwork element (FIG. 1). With the tongue-and-groove joint, it is possible in terms of the fresh concrete to achieve a seating of the forming board element 36 on the forming panel 12 of the formwork element 10 (FIG. 1) that has sufficient load stability.

Another exemplary embodiment of a forming board element 36 is shown in FIGS. 3*a* through 3*d*, which is provided with a total of four through-recesses 40 for one or for multiple connection reinforcement elements.

A concrete formwork 42 that includes a first formwork element 10 according to FIG. 1 and a (conventional) second formwork element 44 are shown in FIG. 4. The formwork element 10 depicted to the right in FIG. 4 corresponds to the formwork element 10 shown in FIG. 1. The edge recesses 32 of this formwork element 10 are each sealed independently of one another in each case with one forming board element 36 according to FIG. 2. The formwork element 10, together with the forming board elements 36, forms a formwork apparatus 45.

The two formwork elements 10, 44 are situated spaced apart from one another with formwork facings 46 facing one another in their predefined forming position for the wall section to be produced. An intermediate space or free space 48 is formed by the framework facings 46 of the two formwork elements 10, 44, into which the fresh concrete is to be introduced for producing a first, in this case, vertically extending (concrete) wall section. Reference numeral 50 refers to an arbitrary concrete structure, in this case in the form of a wall section, on which the wall section is to be produced in fresh concrete design. The wall section is to include connection reinforcement elements 52, which project away or project outwardly in a direction orthogonal to the wall section and which facilitate the connection of a floor (not shown). The connection reinforcement elements 52—here purely as an example, each have a bow-shaped or U-shaped design known in the building practice. A first and a second arm 54 of each connection reinforcement element are connected to one another via a rear section 56. The two arms 54 of the connection reinforcement element 52 each extend via one of the through-recesses 40 of a forming board element 38 through the respective edge recesses 32 of the formwork element 10.

FIG. 5 shows a sectional view of sections of the concrete formwork 42 according to FIG. 4. The tongue-and-groove connection 58 between the forming board element 36 and the forming panel 12 of the formwork element 10 is readily apparent. The forming board element 36 with its formwork facing 46 coming into contact with the fresh concrete projects past the forming panel 12 of the formwork element 10 into the free space 48 in a direction orthogonal to the formwork facing 46. The two-arm connection reinforcement elements 52 are held solely via the forming board elements 36 in their predefined embedded position and embedded location in the free space 48 to be filled with the fresh concrete relative to the formwork element 10.

FIG. 6 shows a horizontal section of the concrete formwork 42. The connection reinforcement elements 52 of the concrete wall section to be produced arranged in series one behind the other are readily apparent. The connection reinforcement elements 52 extend on the rear side beyond the formwork element 10.

FIG. 7 shows a perspective view of the concrete formwork 42 still in its forming position with the solidified concrete wall section 60. The edge recesses 32 are sealed in a fluid-tight manner or essentially fluid tight manner by the formwork inserts 36. The connection reinforcement elements 52 extend in a positive fitting manner or essentially positive fitting manner through respectively assigned through-recesses 40 of the individual forming board elements 36. This ensures a sufficient sealing of the formwork element 10 even in the area of the through-recesses 40.

FIG. 8 shows another exemplary embodiment of a concrete formwork 42. The edge recesses 32 of the formwork element 10 are each provided with a forming board element according to FIG. 3. Two U-shaped connection reinforcement elements 52 extend with their two arms through one each of the formwork inserts 36 of the formwork element 10.

FIG. 9 shows the formwork pattern of the solidified and stripped wall section 60 according to FIG. 7. The (vertically extending) wall surface 62 includes in the area of the exit of the connection reinforcement elements 52 from the wall section 60 in each case an indentation 64, each of which is produced by one of the formwork inserts 36 of the formwork element 10 (cf. FIG. 1). These indentations 62 may offer additional static advantages when connecting a floor to the wall section 60.

Two additional embodiments of a forming board element 36 are shown in FIGS. 10 and 11. The forming board elements 36 according to the FIGS. 10A through 10B, include a cover plate segment 66 and a holding plate segment 68. The holding plate segment 68 has a size and shape that corresponds to the size and shape of the edge recesses 32 of the formwork element 10 according to FIG. 1. The cover plate segment 68 protrudes laterally beyond three side edges 70 of the holding plate segment 68 and, in this way, forms contact surfaces 72, via which the forming board element 36 may be supported on the formwork facing 46 of the forming panel of the formwork element 10 provided with the edge recesses 36. The holding plate segment 68 may protrude with its lower edge area 74 outwardly beyond the cover plate segment 66 in a direction axial to the longitudinal axis 76 of the forming board element 36. The cover plate segment 66 and the holding plate segment 68 are preferably integrally designed. According to FIG. 11, the forming board element 36, like the forming board element 36 shown in FIG. 3, may be provided with more than two, in this case, four through-recesses 40.

FIG. 12 shows the formwork element 10 provided with the forming board elements 36 shown in FIG. 10 in its formed mounting position. Each forming board element 36 is sealingly arranged in an edge recess 32 of the formwork element 10 and encompasses one of the connection reinforcement elements 52. The forming board elements 36 in this case are not held via a tongue-and-groove joint on the forming panel 12, but rather each loosely engage in the relevant edge recess 32. The formwork elements 36 in this case may be held press-fitted on the forming panel 12. Each forming board element 36 is supported via its contact surfaces 72 on the formwork facing 46 of the forming panel 12 of the formwork element 10. At the same time, the forming board elements 36 rest via their lower edge area 74 flush against the concrete structure 50, in each case, on the outside, situated below the wall section to be constructed.

Alternatively, a single forming board element 36, which according to FIG. 13 may be designed in the form of a formwork board 78, may be used to seal the edge recesses 32 of the formwork element 10. The formwork board 82 in this case has a length l, which corresponds to the width of the formwork element 10 (FIG. 1). The formwork board 78 has a width b. The formwork board 78 is made preferably of wood or of a wood material. The formwork board 78 is provided with through-recesses 40 for the respective connection reinforcement elements 52, situated in overlying pairs and apart from one another along the formwork board 78. It is understood that the configuration, shape and size of the through-recesses 52 are coordinated with the respective connection reinforcement elements 52 of the wall section to be constructed to be passed through the formwork board 78.

The formwork element 10, together with the formwork board 78 in its formed position, is visible in FIG. 14. The connection reinforcement elements 52 are each passed through the corresponding through-recesses 40 of the formwork board 78 and thus held on the formwork board 78. The formwork board 78 is supported on its end face on the concrete structure 50, to which the wall section to be constructed is vertically connected.

The formwork element 10 rests with its formwork facing 46 flush against the outside of the concrete structure 50. Because sections of the formwork board 78 are situated on the formwork facing 46 of the formwork element 10, the result according to FIG. 15 is, once the solidified wall section 60 has been stripped, a single indentation 64 in the concrete surface of the wall section 60, from which the connection reinforcement elements 52 exit out of the wall section.

Another exemplary embodiment of a formwork element 10 is shown in FIG. 16. The formwork element 10 differs from the formwork element 10 shown in FIG. 1 essentially in that the formwork facing 12 does not extend between the edge recesses 36 in the direction of the lower edge 24 of the formwork element 10. Instead, the formwork facing 12 in this case has a linearly or essentially linearly extending lower edge 80. The formwork element 10 has a width B. The height of the edge recesses 32 is identified by h. A single formwork board 78, as is already shown in FIG. 13, preferably serves to cover all edge recesses 32 of the formwork element 10. Here, too, the formwork board 78 has a length l corresponding to the width B of the formwork element 10 (FIG. 16). The width b of the formwork board 78 corresponds to the (uniform) height h of the edge recesses 32 of the formwork element 10.

The formwork apparatus 45, together with the formwork element 10 and with the single formwork board 78 in its formed position, is visible in FIG. 17. The connection reinforcement elements 52 are each passed through the corresponding through-recesses 40 of the forming board element 36 designed as a formwork board 78 and thus held on the formwork board 78. The formwork board 78 is smoothly attached with its formwork facing 48 to the formwork facing 46 of the forming panel 12. In this case, the formwork board is supported on its rear side directly on the support structure 14 of the formwork element 10. In the formed state, the formwork board 78 may rest flush against the outside of the concrete structure 50 situated below the wall section to be constructed.

FIG. 18 shows the wall section 60 constructed in fresh concrete design and solidified after stripping. The wall surface 62 of the wall section 60 has on the whole a smooth and indentation-free design.

The method 100 according to the invention for producing a wall section 60 in fresh concrete design, including projecting connection reinforcement elements 52 for connecting a floor, is explained below with additional reference to the FIGS. 19 through 20.

In a first step 102, the wall section 60 to be constructed in fresh concrete design is formed by means of a concrete formwork 42, which comprises a formwork apparatus 45 explained above, so that at least a part of the connection reinforcement elements 52 of the wall section 60 to be constructed extends in each case through one of the edge recesses 32 of the formwork element 10, wherein the edge recesses 32, through which the connection reinforcement elements 52 pass, are covered, either together by a single forming board element 36 (for example, in the form of a formwork board 78; cf. FIG. 17) or each by forming board elements 36 situated at least in sections separately from one another in the respective edge recess 32 (cf. FIGS. 7 and 12).

Each of the multiple forming board elements 36 may be arranged, in particular, may be inserted, in the edge recesses 32 of the formwork element 10 prior to forming. When inserting only one forming board element, in particular, in the form of a formwork board 78, the latter is preferably threaded in advance onto the connection reinforcement elements 52 and only subsequently is the formwork element 10 situated in its forming position predefined for the wall section 60.

In a second step 104, the fresh concrete is introduced into the concrete formwork 42.

In a subsequent step 106, the solidified wall section 60 is stripped. This takes place by vertically lifting 106A the formwork element 10 in order to disengage the connection reinforcement elements 52 from the edge recesses 32 of the formwork element 10. Once the formwork element 10 is initially moved away from the wall section in a direction orthogonal to the surface of the (solidified) wall section 60, in order to detach this from the wall section, it is then sufficient to move the formwork element 10 a few millimeters/centimeters away from the wall section 60. Thus, the formwork element 10 need not be moved to beyond the free end of the connection reinforcement elements 52 in order to be able to move this vertically upwardly (to the next construction section).

Each forming board element 36 remains on the connection reinforcement elements 52 when lifting 106 the formwork element and are removed only in a subsequent step 106B from the respective connection reinforcement elements 52 in a direction orthogonal to the solidified wall section 60.

This is followed by the forming 108 of another (second) wall section 60 that includes projecting connection reinforcement elements 52, which is connected to the wall section 60 vertically above the solidified wall section 60 and to be constructed in fresh concrete design. For this purpose, the previously used formwork board 78 or the previously used formwork boards may be reused or a respective other formwork board 78 or other formwork inserts 36 may be employed.

The invention claimed is:

1. A formwork apparatus for producing vertical wall sections, each of the vertical wall sections being provided with projecting connection reinforcement elements for connecting a floor to be constructed, the formwork apparatus including a formwork element comprising a support structure, a forming panel supported on the support structure, which includes a formwork facing, and a lower edge section which includes a plurality of edge recesses spaced uniformly apart from one another for the passing through of the connection reinforcement elements, and a forming board element or multiple forming board elements for reversibly covering the edge recesses when the connection reinforcement elements extend through the edge recesses, wherein each forming board element is detachably connectable via a tongue-and-groove joint to at least one of the formwork element or the forming panel thereof.

2. The formwork apparatus according to claim 1, wherein each forming board element is movable out of a mounted position on the formwork element in a direction axial to the longitudinal axis of the formwork element.

3. The formwork apparatus according to claim 1, wherein each of the multiple forming board elements are configured to be situated at least in sections in one of the edge recesses.

4. The formwork apparatus according to claim 1, wherein the forming panel extends between two edge recesses situated adjacent to one another.

5. The formwork apparatus according to claim 1, wherein a width of each of the edge recesses tapers toward a center of the formwork element.

6. The formwork apparatus according to claim 1, wherein the support structure is formed by a plurality of longitudinal members, which are detachably or non-detachably connected to one another via cross members.

7. The formwork apparatus according to claim 6, wherein the formwork element is designed as a frame panel formwork element.

8. The framework apparatus according to claim 1, wherein the forming board element in a mounted state on the support structure of the formwork element is situated with its formwork facing flush or essentially flush with the formwork facing of the forming panel.

9. A formwork system for forming a concrete structure, the concrete structure having a connection reinforcement element projecting therefrom, comprising:

a formwork element, comprising:

at least one support structure;

at least one forming panel supported by the support structure, the at least one formwork panel including a formwork facing, the at least one formwork panel having a lower edge section defining a plurality of uniformly spaced recesses; and at least one forming board element configured to reversibly cover at least one of the plurality of uniformly spaced recesses when the at least one connection reinforcement element extends through at least one of the plurality of uniformly spaced recesses, the at least one forming board element being detachably connectable via a tongue-and-groove joint to at least one of the formwork element or the at least one forming panel.

10. The formwork system of claim 9, wherein the at least one forming board element comprises a plurality of forming board elements.

11. The formwork system of claim 9, wherein the concrete structure comprises a vertical wall section.

12. A formwork system for forming concrete structures, at least one of the concrete structures having at least one connection reinforcement element having a first arm and a second arm projecting therefrom, comprising:

a formwork element, comprising:

at least one support structure;

at least one forming panel supported by the support structure, the at least one formwork panel including a formwork facing, the at least one formwork panel having a lower edge section defining a plurality of uniformly spaced recesses, wherein a width of each of the plurality of uniformly spaced recesses tapers toward a center of the formwork element; and at least one forming board element defining at least two through-recesses and being configured to reversibly cover at least one of the plurality of uniformly spaced recesses when the first arm and the second arm of the at least one connection reinforcement element extend respectively through the at least two through-recesses of the at least one forming board element.

13. The formwork system of claim 12, wherein the at least one forming board element comprises a plurality of forming board elements.

14. The formwork system of claim 12, wherein the concrete structure comprises a vertical wall section.

15. The formwork system of claim 12, wherein the plurality of uniformly spaced recesses define a trapezoidal shape.

* * * * *